United States Patent [19]

Ito et al.

[11] Patent Number: 5,076,484

[45] Date of Patent: Dec. 31, 1991

[54] JOINING STRUCTURE OF A TURBINE ROTOR

[75] Inventors: Masaya Ito, Kasugai; Seiji Mori, Kounan, both of Japan

[73] Assignee: NGK Spark Plug Co., Ltd., Aichi, Japan

[21] Appl. No.: 658,143

[22] Filed: Feb. 20, 1991

[30] Foreign Application Priority Data

Mar. 29, 1990 [JP] Japan ..... 2-81934

[51] Int. Cl.[5] ..... B23K 31/02

[52] U.S. Cl. ..... 228/122; 228/135; 403/30; 403/272

[58] Field of Search ..... 228/122, 135, 138; 403/28, 29, 30, 268, 272, 404

[56] References Cited

U.S. PATENT DOCUMENTS

| | | | |
|---|---|---|---|
| 3,666,302 | 5/1972 | Kellett | 403/28 |
| 4,659,245 | 4/1987 | Hirao et al. | 403/30 |
| 4,740,429 | 4/1988 | Tsuno | 428/632 X |
| 4,778,345 | 10/1988 | Ito et al. | 229/231 X |

FOREIGN PATENT DOCUMENTS

| | | | |
|---|---|---|---|
| 3535511 | 4/1986 | Fed. Rep. of Germany . | |
| 59-103902 | 6/1984 | Japan . | |
| 60-82267 | 5/1985 | Japan | 228/263.12 |
| 61-91073 | 5/1986 | Japan . | |
| 91074 | 5/1986 | Japan . | |
| 1100071 | 4/1989 | Japan . | |

*Primary Examiner*—Richard K. Seidel
*Assistant Examiner*—Patty E. Hong
*Attorney, Agent, or Firm*—Sughrue, Mion, Zinn, Macpeak & Seas

[57] ABSTRACT

In a joining structure of a turbine in which a shaft portion of a ceramic turbine rotor is joined to a metal shaft in the through bore of a metal sleeve by brazing, the joining structure of this invention comprises a first flange formed on the metal sleeve, the first flange extending toward the axis of the through bore, a second flange formed on the metal shaft, the second flange extending outward and the outside diameter thereof being larger than the inner diameter of the first flange, wherein side surfaces of the first and the second flanges are engaged and brazed with each other. An intermediate layer may be interposed between the bottom end of the shaft portion of the turbine rotor and the bottom end of the metal shaft for reinforcement. The intermediate layer is made of one or more than one metal selected from the group consisting of Ni, Cu, Fe, Ag, KOVAR, Fe-Ni Alloy, and W alloy.

20 Claims, 5 Drawing Sheets

JOINING STRUCTURE OF A TURBINE ROTOR

BACKGROUND OF THE INVENTION

The present invention relates to a joining structure of a turbine. More particularly, the present invention relates to a joining structure of a turbine that joins a shaft of a ceramic turbine rotor to a metal shaft.

Generally, in the joining structure of a turbine a shaft of a ceramic turbine rotor and a metal shaft are in abutting connection with each other such that the ceramic turbine rotor and the metal shaft are placed in the same axis. The joined rotor shaft and the metal shaft are enclosed by a sleeve for reinforcement.

One such joining structure is illustrated in FIG. 6A. In a turbine P1, a rotor shaft P3 of a ceramic turbine rotor P2, a sleeve P4 made of a low expansion rate metal are joined to each other by brazing or shrinkage fitting. After the brazing or shrinkage fitting, a metal shaft P6 is welded to an abutment face P5 of the sleeve P4.

In the related-art turbine P7 of FIG. 6B, on the other hand, a rotor shaft P9 of a ceramic turbine P8, a sleeve P10 made of a low expansion rate metal, and a metal shaft P11 are joined into one piece via a joining layer P12 by brazing.

The above joining methods have been found to be insufficient for the following reasons. In the first joining structure, the turbine rotor P2, the sleeve P4, and the metal shaft P6 cannot be joined at the same time, hence requiring additional manufacturing steps. In the second method, if the joint of the sleeve P10 and the metal shaft P11 is heated above 400° C., a brazing material P13 may be oxidized. This reduces the bonding strength and eventually causes disconnection of the metal shaft P11 or damage to the sleeve P10 and the metal shaft P11.

Therefore, an object of the present invention made to overcome the above problems is to provide a joining structure of a turbine which requires fewer manufacturing steps than the conventional structures and which has a high bonding strength.

Other objects and benefits of the invention will become apparent from the detailed description which follows hereinafter when taken in conjunction with the drawing figures which accompany it.

SUMMARY

The foregoing object has been achieved in the joining structure of a turbine in accordance with the present invention in which a shaft portion of a ceramic turbine rotor is joined to a metal shaft in a through hole of a metal sleeve by brazing, the joining structure comprises a first flange formed on the metal sleeve, the first flange extending toward the axis of the through hole, a second flange formed on the metal shaft, the second flange extending outward and the outside diameter thereof being larger than the inner diameter of the first flange, wherein side surfaces of the first and the second flanges are engaged and brazed with each other.

In the joining structure of this invention, in which a intermediate layer is interposed between the bottom end of the shaft portion of the turbine rotor and the bottom end of the metal shaft, the intermediate layer is preferably of one or more than one metal selected from the group consisting of Ni, Cu, Fe, Ag, KOVAR, Fe-Ni alloy, and W alloy.

Silicon or SIALON will suffice for the material for the ceramic turbine.

It is preferable to use a metal having a low expansion rate such as KOVAR or incoloy 903 for a material for the metal sleeve.

Furthermore, alloys such as SNCM 439, SNCM 447, and SNCM 630 (the above four and similar codes in the present specification are alloy numbers of Japanese Industrial Standard) are appropriate as a material for the metal shaft. The above metal members may be plated with Ni, Cu, Ag, or some other material to improve the wettability of the brazing material.

Silver solder, copper solder, Ni solder, and so forth will suffice for brazing. Any of the above brazing materials containing Ti may also be used.

A metal disk made of a soft metal such as Ni, Cu, Fe, Ag, or the like, or a metal having a low expansion rate including KOVAR, Fe-Ni alloy, and W alloy are most appropriate as the intermediate layer described above.

The first and the second flanges preferably have the same height all around the metal sleeve and the metal shaft, respectively, because applied stress is evenly dispersed and high bond strength is attained.

In operation, the shaft portion of the ceramic turbine rotor and the metal shaft are brought into abutting contact with each other. Because the outer diameter of the second flange is larger than the inner diameter of the first flange, side surfaces of the first and the second flanges are engaged with each other. Moreover, one brazing operation securely joins the engaged surfaces, the metal sleeve, the shaft portion, and the metal shaft. This way, the bond strength also improves.

With a turbine being constructed as explained above, even if the joint of the brazed metal members, that is, the metal sleeve and the metal shaft, is oxidized and the bond strength decreases, the metal shaft does not come out of the metal sleeve and the metal members do not break because side surfaces of the first and the second flanges are engaged with each other.

The intermediate layer, having the above composition and being interposed between the bottom end of the shaft portion of the turbine rotor and the bottom end of the metal shaft, further enhances the bond strength.

DESCRIPTION OF THE PREFERRED EMBODIMENTS

Several preferred embodiments of the present invention will be explained hereinafter with reference to the attached drawings.

First Embodiment

Figure 1A:
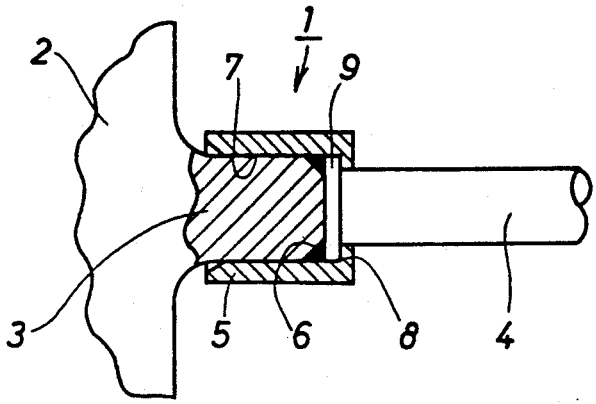
FIG. 1A is a fragmentary sectional view of a turbine rotor shaft-joining structure of a first embodiment of the present invention.

FIG. 1A shows a turbocharger (turbine) 1 embodying the present invention. The turbine 1 comprises a turbine rotor 2 made of ceramic (a gas pressure sintered silicon carbide), a rotor shaft 3 integratedly formed on the turbine rotor 2, a journal (metal shaft) 4 being in abutting contact with the rotor shaft 3 such that the rotor shaft 3 and the metal shaft 4 are arranged in the same axis, and a cylindrical metal sleeve 5 that encloses the rotor shaft 3 and the metal shaft 4.

The rotor shaft 3 has a diameter of 12.0 mm and the edge of the rotor shaft 3 is chamfered at 6 by 0.5 mm by a diamond grindstone.

The metal sleeve 5 made of incoloy 903 is provided on its outer end with a first flange 8 extending toward the axis of the through bore 7 of the sleeve 5. The bore diameter of the metal sleeve 5 is made 12.1 mm while the bore diameter of the bore formed by the first flange 8 is made 10.1 mm such that the rotor shaft 3 of the turbine rotor 2 and the metal shaft 4 can be inserted therein.

The metal shaft 4 is made of SNCM 630 and has an outwardly extending second flange 9 formed on the end thereof. The outer diameter of the metal shaft 4 measures 10.0 mm while the outer diameter of the second flange 9 measures 12.0 mm. The second flange 9 measures 1.5 mm in thickness.

In order to improve wettability of the brazing material, the surface of the metal sleeve 5 is plated in two layers: first with 5 μm Ni; and secondly with 25 μm Cu while the metal shaft 4 is plated with 5 μm Ni.

Figure 1B:
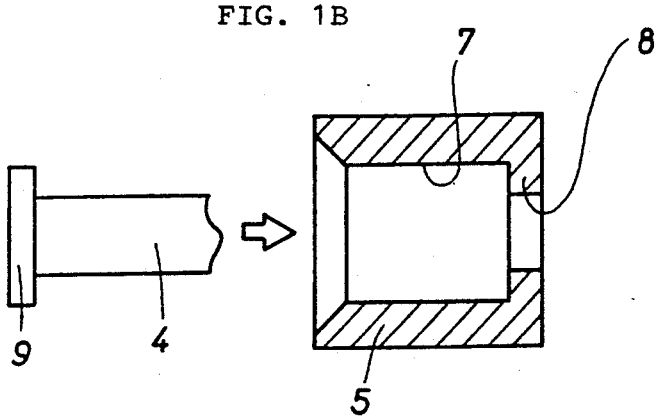
FIG. 1B is an enlarged exploded view of part of the turbine rotor shaft-joining structure shown in FIG. 1A.
Figure 1C:
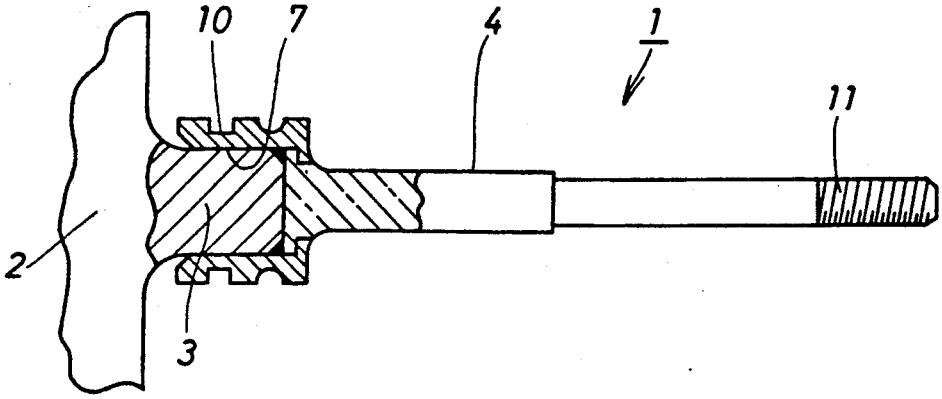
FIG. 1C is a fragmentary sectional view of a completed turbine rotor shaft-joining structure of the first embodiment.

The preferred manufacturing method for joining of the turbine 1 according to this embodiment is as follows. As shown in FIG. 1B, the metal shaft 4 is inserted into the through bore 7 of the metal sleeve 5 through the opening where the second flange is not formed until the first flange 8 is brought into engaging contact with the second flange 9. Then, as shown in FIG. 1C, the rotor shaft 3 of the turbine rotor 2 is inserted in the through bore 7 and brought into abutting contact with the metal shaft 4. At this point, heating at 850° C. is performed for 15 minutes in a vacuum to carry out brazing between the metal sleeve 5 and the rotor shaft 3 and between the first flange 8 and the second flange 9. A disk-shaped brazing material such as BAg8 may be placed between the rotor shaft 3 and the metal shaft 4 prior to the heating operation. Alternatively, a ring-shaped brazing material may be placed between the first and the second flanges 8 and 9. After the brazing operation, a groove 10, threads 11, and so forth are machined to complete manufacturing the turbine 1.

Second Embodiment

Figure 2A:
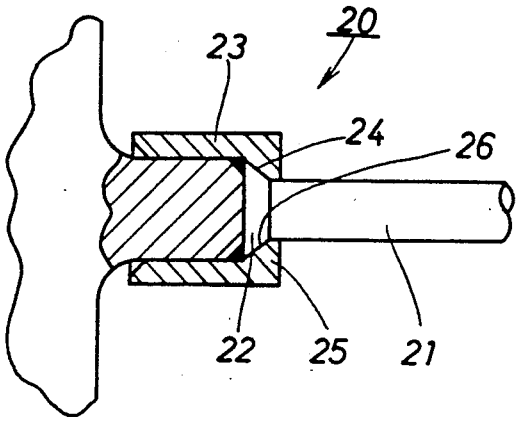
FIG. 2A is a fragmentary sectional view of a turbine rotor shaft-joining structure of a second embodiment of the present invention.
Figure 2B:
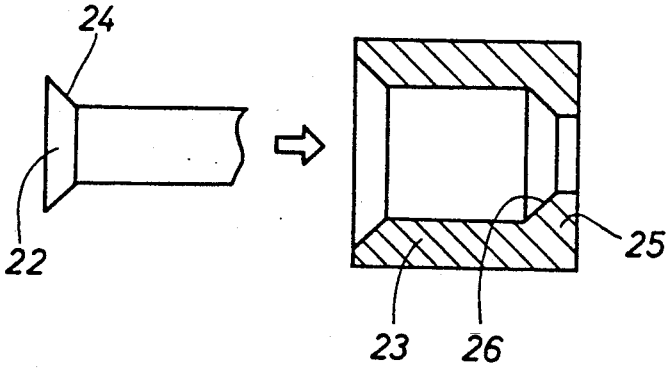
FIG. 2B is an enlarged exploded view of part of the turbine rotor shaft-joining structure shown in FIG. 2A.

A turbine 20 of a second embodiment will be explained hereinafter referring to FIGS. 2A and 2B. As shown in FIGS. 2A and 2B, the turbine 20 of the present embodiment differs from the turbine 1 of the first embodiment in the shape of the second flange 22 formed on the metal shaft 21. The second flange 22 is not cylindrical but a circular truncated cone whose side surface 24 tapers toward the metal shaft 21. Accordingly, an inner side surface 26 of the first flange 25 of the metal sleeve 23 tapers such that the inner side surface 26 fits the side surface 24.

This embodiment offers the advantage that the first flange 25 does not break easily under a large stress because the base of the first flange 25 is made thick.

Third Embodiment

Figure 3A:
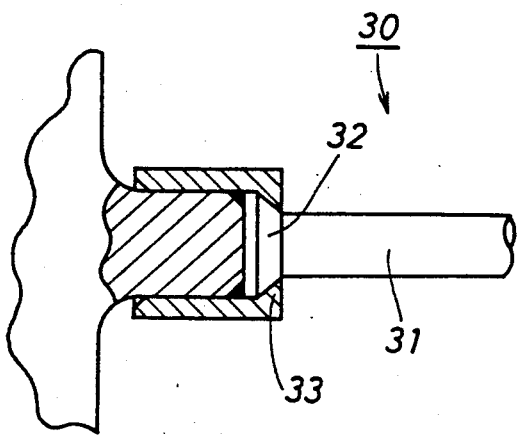
FIG. 3A is a fragmentary sectional view of a turbine rotor shaft-joining structure of a third embodiment of the present invention.
Figure 3B:
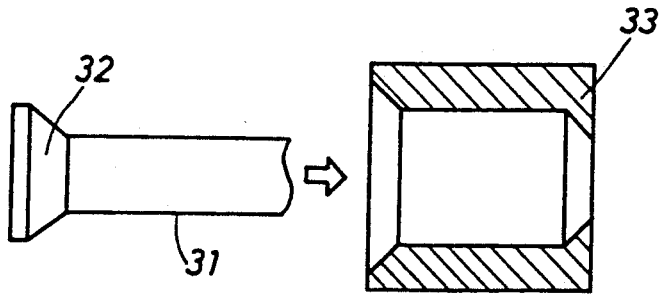
FIG. 3B is an enlarged exploded view of part of the turbine rotor shaft-joining structure shown in FIG. 3A.

A turbine 30 of a third embodiment will be explained hereinafter referring to FIGS. 3A and 3B. As shown in FIGS. 3A and 3B, the turbine 30 of this embodiment also differs from the turbine 20 of the second embodiment in the shape of the second flange 32 formed on the metal shaft 31. As can be seen from the drawing figure, the second flange 32 is not cylindrical; but, rather, a combination of a cylinder and a circular truncated cone.

This embodiment also offers the advantage that the first flange 25 does not break easily under a large stress because the base of the second flange 32 as well as that of the first flange 33 is made thick.

Fourth Embodiment

Figure 4:
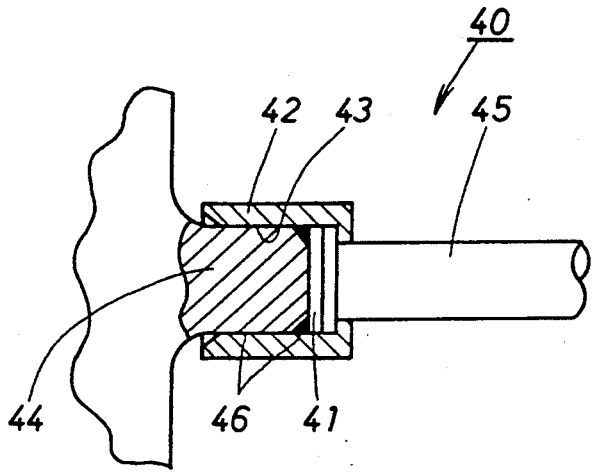
FIG. 4 is a fragmentary sectional view of a turbine rotor shaft-joining structure of a fourth embodiment of the present invention.

A turbine 40 of a fourth embodiment will be explained hereinafter based on FIG. 4. As shown in FIG. 4, unlike the turbine 1, 20, and 30 of the above-described embodiments, the turbine 40 of this embodiment is provided with an intermediate disk 41.

The rotor shaft 44 is brought into contact with the metal shaft 45 via the intermediate disk 41 made of Ni, or the like, in the through bore 43 of a cylindrical metal sleeve 42 similar to those of the previous embodiments. The dimensions of the intermediate disk 41 are 12.0 mm in diameter and 0.25 mm in thickness. The rotor shaft 44 and the metal shaft 45 are brazed by a brazing material 46. The brazing material not only spreads between the rotor shaft 44 and the metal shaft 45; but, also permeates between the metal sleeve 42 and the rotor shaft 44 and through the entire surface of the intermediate disk 41.

The present embodiment provides superior bond strength because the intermediate disk 41 that has the above-described composition is interposed between the rotor shaft 42 and the shaft 45.

Figure 5:
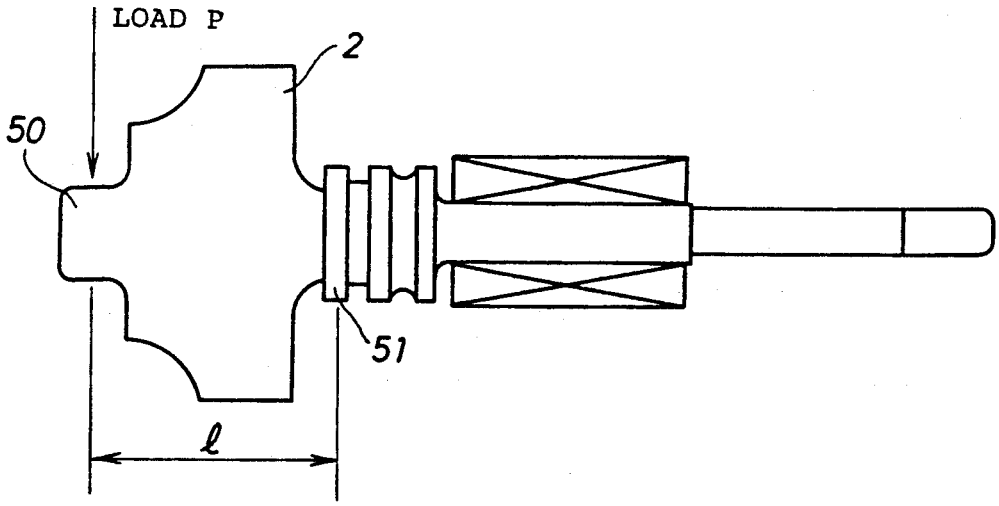
FIG. 5 is an explanatory view of a breakdown test conducted to determine the flexural strength of the turbine rotor shaft-joining structures of the first and the fourth embodiment of the present invention.
Figure 6A:
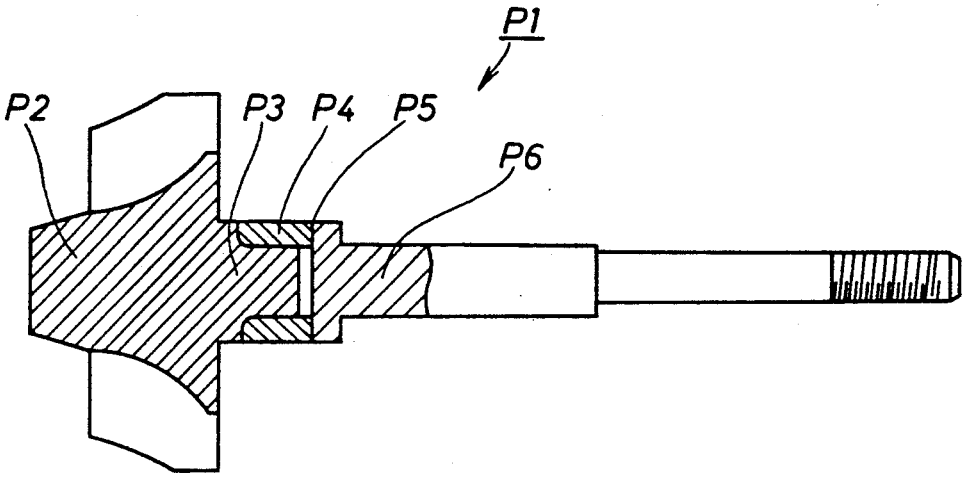
FIG. 6A RELATED ART
FIG. 6A is a fragmentary sectional view of a related art approach to turbine rotor shaft-joining structures.
Figure 6B:
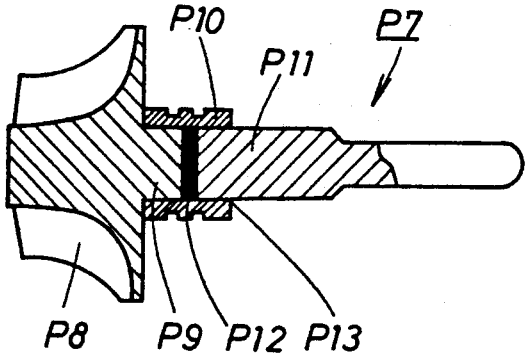
FIG. 6B RELATED ART
FIG. 6B is a fragmentary sectional view of another related art approach to turbine rotor shaft-joining structures.

Experiments were conducted to determine the bond strength of the turbine rotors 1 and 40 of the first and the fourth embodiments, respectively. The experiments will be explained below based on FIG. 5.

(Experiment 1)

The turbine 1 and 40 were mounted on automobile engines. The exhaust gas temperature was set at 900° C. and the engine speed was set at 120,000 rpm. No damage was observed in the turbine 1 and 40 and their joints were secure.

(Experiment 2)

A breakdown test was conducted, using five each of the first and the fourth turbines 1 and 40. While each rotor was held by the shaft 4 or 45 thereof, a load P was applied to a head 50 of the turbine rotor 2.

The flexural strength $\sigma$ of the turbine 1 and 40 was obtained by the following equation:

$$\sigma = 32Pl/\pi d^3 \ldots \quad (1)$$

In the above equation (1), l denotes the distance between the load point (the head 50) and a metal sleeve end 51 from which point the rotor shaft is no longer enclosed by the metal sleeve; and d denotes the diameter of the rotor shaft. The average flexural strength $\sigma$ of the turbine 1 of the first embodiment was 37 kg/mm$^2$ while that of the turbine 40 of the fourth embodiment was 42 kg/mm$^2$, exhibiting sufficiently high flexural strength in both cases. The fourth embodiment using the intermediate disk 41 made of Ni exhibited particularly high strength.

In the present invention, since the first and the second flanges are engaged and brazed with each other, a turbine rotor can easily be manufactured in a more simplified process. Moreover, even if the bond strength effected by brazing decreases due to oxidization, neither the shaft nor the metal member breaks off.

Wherefore, having thus described the present invention, what is claimed is:

1. In a joining structure of a turbine in which a shaft portion of a ceramic turbine rotor is joined to a metal shaft in a through bore of a cylindrical metal sleeve by brazing, the improvement wherein the joining structure comprises:

a) a first flange formed on the metal sleeve, said first flange extending inwardly toward an axis of the through bore; and, b) a second flange formed on the metal shaft, said second flange extending outward and an outside diameter thereof being larger than an inner diameter of said first flange, wherein side surfaces of said first flange and said second flange are engaged and brazed with each other.

2. The improvement to a joining structure of claim 1 and additionally comprising:

an intermediate layer interposed between a bottom end of the shaft portion of the turbine rotor and a bottom end of the metal shaft, said intermediate layer being made of at least one metal selected from the group consisting of Ni, Cu, Fe, Ag, KOVAR, Fe-Ni alloy, and W alloy.

3. The improvement to a joining structure of claim 1 wherein:

an abutting end of the shaft portion of the ceramic turbine rotor is chamfered at an outer periphery where it abuts said second flange.

4. The improvement to a joining structure of claim 1 wherein:

a) said second flange is frusto-conical in shape having a larger diameter at an end which abuts the shaft portion of the ceramic turbine rotor; and, b) said first flange is chamfered on an inner surface which abuts said second flange to mate with said frusto-conical shape of said second flange.

5. The improvement to a joining structure of claim 1 wherein:

a) said second flange is combined cylindrical and frusto-conical in shape having a larger diameter at a cylindrical end which abuts the shaft portion of the ceramic turbine rotor; and, b) said first flange is chamfered on an inner surface which abuts said second flange to mate with a frusto-conical portion of said second flange.

6. Joining apparatus for use in a turbine to join a shaft portion of a ceramic turbine rotor to a metal shaft by brazing comprising:

a) a cylindrical metal sleeve having a concentric through bore therethrough and a first flange formed adjacent an end thereof, said first flange extending radially inwardly toward an axis of the through bore to form an inner bore which is a slide fit for the metal shaft which is disposed therethrough; and, b) a second flange formed on the metal shaft, said second flange extending radially outward with an outside diameter thereof being larger than an inside diameter of said first flange and a slide fit to an inside diameter of said sleeve, said second flange being disposed with said metal sleeve in abutting relationship to said first flange and in which positional relationship side surfaces of said first flange and said second flange are engaged and brazed with each other.

7. The joining apparatus of claim 6 and additionally comprising:

an intermediate layer interposed between a bottom end of the shaft portion of the turbine rotor and a bottom end of the metal shaft, said intermediate layer being made of at least one metal selected from the group consisting of Ni, Cu, Fe, Ag, KOVAR, Fe-Ni alloy, and W alloy.

8. The joining apparatus of claim 6 wherein:

an abutting end of the shaft portion of the ceramic turbine rotor is chamfered at an outer periphery where it abuts said second flange.

9. The joining apparatus of claim 6 wherein:

a) said second flange is frusto-conical in shape having a larger diameter at an end which abuts the shaft portion of the ceramic turbine rotor; and, b) said first flange is chamfered on an inner surface which abuts said second flange to mate with said frusto-conical shape of said second flange.

10. The joining apparatus of claim 6 wherein:

a) said second flange is combined cylindrical and frusto-conical in shape having a larger diameter at a cylindrical end which abuts the shaft portion of the ceramic turbine rotor; and, b) said first flange is chamfered on an inner surface which abuts said second flange to mate with a frusto-conical portion of said second flange.

11. A breakage-resistant joint in a turbine joining a shaft portion of a ceramic turbine rotor to a metal shaft comprising:

a) a cylindrical metal sleeve having a concentric through bore therethrough and a first flange formed adjacent an end thereof, said first flange extending radially inwardly toward an axis of the through bore to form an inner bore which is a slide fit for the metal shaft which is disposed therethrough;

b) a second flange formed on the metal shaft, said second flange extending radially outward with an outside diameter thereof being larger than an inside diameter of said first flange and a slide fit to an inside diameter of said sleeve, said second flange being disposed within said metal sleeve in abutting relationship to said first flange with side surfaces of said first flange and said second flange engaged with each other; and, c) brazing material bonded to said side surfaces of said first flange and said second flange.

12. The joint of claim 11 and additionally comprising:

an intermediate layer interposed between a bottom end of the shaft portion of the turbine rotor and a bottom end of the metal shaft, said intermediate layer being made of at least one metal selected from the group consisting of Ni, Cu, Fe, Ag, KOVAR, Fe-Ni alloy, and W alloy.

13. The joint of claim 11 wherein:

an abutting end of the shaft portion of the ceramic turbine rotor is chamfered at an outer periphery where it abuts said second flange.

14. The joint of claim 11 wherein:

a) said second flange is frusto-conical in shape having a larger diameter at an end which abuts the shaft portion of the ceramic turbine rotor; and, b) said first flange is chamfered on an inner surface which abuts said second flange to mate with said frusto-conical shape of said second flange.

15. The joint of claim 11 wherein:

a) said second flange is combined cylindrical and frusto-conical in shape having a larger diameter at a cylindrical end which abuts the shaft portion of the ceramic turbine rotor; and, b) said first flange is chamfered on an inner surface which abuts said second flange to mate with a frusto-conical portion of said second flange.

16. A method of making a breakage-resistant joint for joining a shaft portion of a ceramic turbine rotor to a metal shaft in a turbine comprising the steps of:

a) forming a cylindrical metal sleeve having a concentric through bore therethrough and a first flange formed adjacent an end thereof, the first flange extending radially inwardly toward an axis of the through bore to form an inner bore which is a slide fit for the metal shaft;

b) forming a second flange on an end of the metal shaft, the second flange extending radially outward with an outside diameter thereof being larger than an inside diameter of the first flange and a slide fit to an inside diameter of the sleeve;

c) positioning the second flange within the metal sleeve in abutting relationship to the first flange with side surfaces of the first flange and the second flange engaged with each other;

d) positioning the metal sleeve over the shaft portion of the ceramic turbine rotor with an end of the shaft portion abutting the second flange;

e) disposing brazing material adjacent to side surfaces of the first flange and the second flange; and, f) heating the first flange and the second flange to a brazing temperature for a time sufficient for the brazing material to braze the side surfaces of the first flange and the second flange together.

17. The method of claim 16 and additionally comprising the steps of:

a) providing an intermediate layer made of at least one metal selected from the group consisting of Ni, Cu, Fe, Ag, KOVAR, Fe-Ni alloy, and W alloy; and, b) disposing the intermediate layer between a bottom end of the shaft portion of the turbine rotor and a bottom end of the metal shaft.

18. The method of claim 17 and additionally comprising the step of:

chamfering an abutting end of the shaft portion of the ceramic turbine rotor is chamfered at an outer periphery where it abuts the second flange.

19. The method of claim 17 and additionally comprising the steps of:

a) making the second flange frusto-conical in shape having a larger diameter at an end which abuts the shaft portion of the ceramic turbine rotor; and, b) chamfering the first flange on an inner surface which abuts the second flange to mate with the frusto-conical shape of the second flange.

20. The method of claim 17 and additionally comprising the steps of:

a) making the second flange combined cylindrical and frusto-conical in shape having a larger diameter at a cylindrical end which abuts the shaft portion of the ceramic turbine rotor; and, b) chamfering the first flange on an inner surface which abuts the second flange to mate with a frusto-conical portion of the second flange.

* * * * *